United States Patent [19]

Shimizu et al.

[11] 4,221,145

[45] Sep. 9, 1980

[54] RUNNING WEB CUTTING MACHINE

[75] Inventors: Shigehisa Shimizu; Shigemitsu Mizutani, both of Minami-ashigara, Japan

[73] Assignee: Fuji Photo Film Co., Ltd., Minami-ashigara, Japan

[21] Appl. No.: 960,546

[22] Filed: Nov. 14, 1978

[30] Foreign Application Priority Data

Nov. 14, 1977 [JP] Japan ..... 52-135652

[51] Int. Cl.[3] ..... B26D 1/56

[52] U.S. Cl. ..... 83/71; 83/110; 83/298; 83/320

[58] Field of Search ..... 83/298, 295, 320, 317, 83/316, 71, 110

[56] References Cited

U.S. PATENT DOCUMENTS

| | | | |
|---|---|---|---|
| 1,844,107 | 2/1932 | Sheperdson | 83/317 |
| 1,878,121 | 9/1932 | Edwards | 83/317 |
| 3,543,624 | 12/1970 | Richards | 83/298 X |
| 4,103,575 | 8/1978 | Utsui et al. | 83/298 |

*Primary Examiner*—Frank T. Yost

*Attorney, Agent, or Firm*—Sughrue, Rothwell, Mion, Zinn and Macpeak

[57] ABSTRACT

A running web cutting device in which a vertically movable cutter is driven by a crank mechanism. A reciprocating stand holding an upper cutting edge and lower cutting edge is provided in such a manner to be moved in the direction of advancement of a web by a reciprocating guide. The upper and lower cutting edges are driven through the same crank shaft coupled to a cutter driving motor. A value $\bar{J}$ ($\bar{J}$=J Wo/To where J is the conversion inertial moment of a driving motor including a load, Wo is the rated speed thereof, and To is the rated torque thereof) of said cutter driving motor is represented by $\bar{J}_C$ while a value $\bar{J}$ of a web feeding motor driving a web feeding drum is represented by $\bar{J}_F$. The cutter driving motor and the web feeding motor are chosen so that $\bar{J}_C$ smaller than $\bar{J}_F$. Pulse generators are coupled to the web feeding motor and the cutter driving motor, respectively, and a pulse thinning-out circuit for controlling a movement speed, in the direction of advancement of said web, of said cutter is provided in a control circuit of the cutter driving motor.

11 Claims, 5 Drawing Figures

RUNNING WEB CUTTING MACHINE

BACKGROUND OF THE INVENTION

This invention relates to a running web cutting machine in which a web being run is cut at high speed with high accuracy and the length of a piece of cut web can be changed as desired. The term "web" as herein used is intended to mean a relatively long and flexible material which is, in general, 5μ to 5 mm in thickness and 10 cm to 3 m in width. These dimensions are only exemplary. The web may be a plastic film of polyvinylchloride, polycarbonate, acrylic nitrile, styrene copolymer, ABS resin, polyester, polyester resin containing glass fibers, or cellulose dielectric. It may also be a sheet of paper or synthetic paper; or a metal foil of aluminum, copper or the like.

Running web cutting machines for cutting a web are in general known in the art. In such a machine, which while the length of the web being run is being measured with a measuring roll, a rotary cutter or a vertically movable cutter driven by a crank mechanism is operated by an electric motor control system. However, such a conventional cutting machine is disadvantageous in the following respects:

(1) In a rotary-cutter having the upper and lower cutting edges arranged in the form of a drum, the cutting edges are positioned through a driving gear. Therefore, it is difficult to obtain clearance and abutting force with high accuracy, and accordingly it is difficult to precisely and sharply cut the web.

(2) In order to sharply cut the web, it is necessary to increase to a certain extent the engagement depth of the cutting edges. This leads to an increase of the diameter of the drum. This is not suitable for short cutting.

(3) With a rotary cutter, the speed of the web in the direction of advancement of the web is changed greatly during the cutting operation. Therefore, it is impossible to precisely and sharply cut the web.

(4) In a method in which the speed and position of the web are detected by the measuring roll, the measuring roll must be brought into contact with the web. This may scratch or cut the web.

(5) When the speed of the web is varied greatly, the cutter cannot follow the speed variations. In this case, it is difficult to precisely and sharply cut the web.

(6) With the rotary cutter or a conventional swinging type cutter, the upper and lower cutting edges engage each other after the web is cut. As a result, the web is liable to move upwards, and therefore the web may be fluttered or scratched.

(7) If a spiral cutting edge is used, the speed of the web may be set to a constant value. However, in this case, it is difficult to manufacture such a cutting edge, and furthermore it is difficult to precisely and sharply cut the web.

SUMMARY OF THE INVENTION

Accordingly, an object of this invention is to provide a running web cutting machine in which all of the above-described drawbacks accompanying a conventional running web cutting machine have been eliminated.

It is another object of this invention to provide a system in which the web is precisely and sharply cut without being fluttered or scratched.

Yet another object of this invention is to provide a system wherein the length of a piece of cut web can be changed as desired.

Still another object of this invention is to provide a system wherein two webs slightly different in size can be cut simultaneously, and the web can be cut with notches or curvatures.

In the running web cutting machine according to this invention, a web main-feeding drum (which is, for instance, a suction drum) is coupled through a coupling high in rigidity to a feeding motor. If necessary, a reduction gear (for instance, a precise worm reduction gear) small in backlash is coupled through a coupling high in rigidity, and a tachometer generator and a pulse generator are coupled to the other end of the feeding motor.

The inertial moment of a feeding drum is designed so that a value $\bar{J}_F$($J_F$=J Wo/To, where J is the conversion inertial moment of a motor shaft including load, Wo is the rated speed thereof, and To is the rated torque thereof) of the feeding motor is higher than a value $\bar{J}_C$ of a cutter driving motor. If necessary, a flywheel is provided. If it is required to cut first and second webs laid one on another, a sub-feeding drum for feeding the second web is provided. The inertial moments of feeding motors are designed so that the values $\bar{J}_S$, $\bar{J}_F$ and $\bar{J}_C$ of the sub-feeding motor, main-feeding motor and cutter driving motor meet the following expression:

$$\bar{J}_F > \bar{J}_S > \bar{J}_C$$

By setting the values of $\bar{J}$ to meet the above-described expression, the variation in speed of the main-feeding drum can be reduced, while the speeds of the cutter and the sub-feeding drum can be readily controlled. Especially, the speed of the cutter can be readily controlled. Thus, the web can be cut with high accuracy.

To drive the cutter, a crank mechanism is employed because its speed variation in the direction of advancement of the web is much less than that in the case of the rotary cutter during the cutting operation. More specifically, the cutter is designed so that a reciprocating section holding upper and lower cutting edges is made to be movable in the direction of advancement of the web by a guide. The upper cutting edge is configured to be movable perpendicularly to the lower cutting edge by a vertical movement guide provided in the swinging section. The two cutting edges are driven through one and the same crank shaft coupled to the cutter driving motor.

Furthermore, in the situation where the web is to be cut with higher accuracy, the lateral movement speed of the cutter is made to be equal to the running speed of the web during the cutting operation. That is, the cutter driving motor is controlled by a pulse thinning-out circuit which operates to thin out the pulse output, indicating the running length of the web, of a pulse generator coupled directly to a feeding motor. Hence the web is not cut obliquely in section. Thus, the speed of the cutter driving motor is controlled so that the web running speed is equal to the lateral movement speed of the cutter during the cutting operation.

In order to readily collect pieces of cut web into a web collecting tray, it is preferable that the speed of a catch conveyer provided behind the cutter be set to a constant value higher than the speed of the web when the speed of the web is in a low speed range. The speed of the catch conveyer is set to a value higher by a predetermined ratio than the speed of the web when it is higher than a predetermined value. Furthermore, a digital circuit may be provided so that the feeding length of the sub-feeding drum is shorter by a predetermined value than the feeding length of the main-feeding drum. When the webs are cut, the speeds of the two drums are made to be equal to each other.

This invention will now be described with relation to the accompanying drawings and the description of the preferred embodiment that follows.

DESCRIPTION OF THE PREFERRED EMBODIMENT

Figure 1:
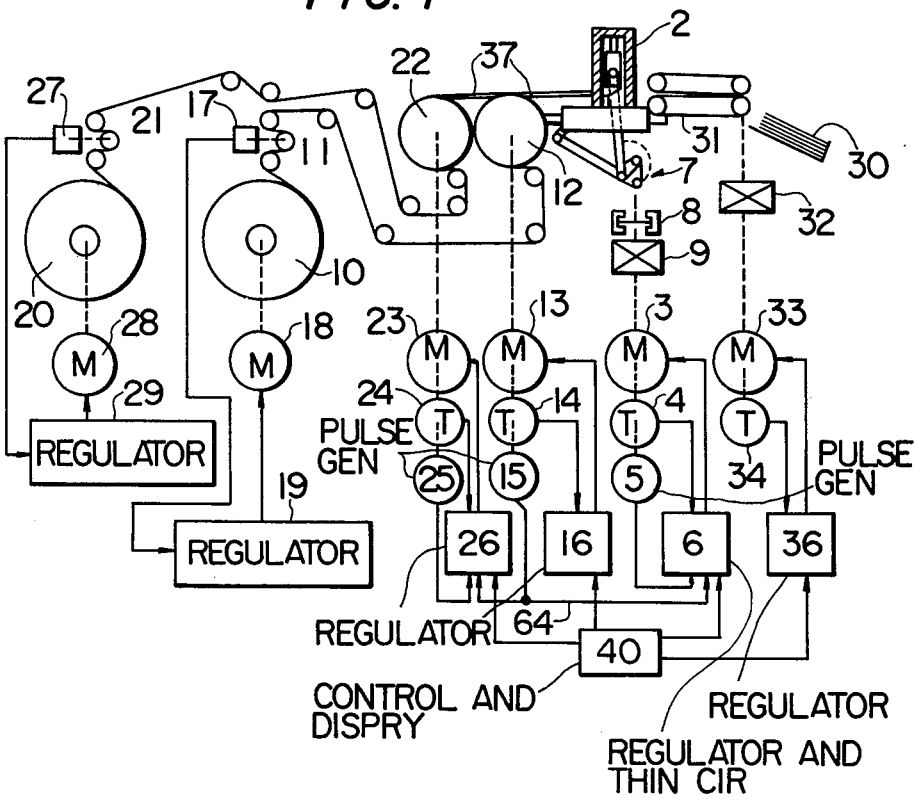
FIG. 1 is an explanatory diagram showing one embodiment of this invention.

As is illustrated in FIG. 1, one end of a main-web loaded on a roll 10 is pulled out by means of a tension pick-up roll 11 and is then conveyed to the position of a cutter by a main-feeding suction drum 12. One end of a sub-web loaded on a roll 20 is pulled out by means of a tension pick-up roll 21 and is then conveyed together with the main-web by a sub-feeding drum 22.

In FIG. 1, reference numerals 17 and 27 designate tension pick-ups, reference numerals 18 and 28 designate tension controlling motors, and reference numerals 19 and 29 designate the regulators of the motors 18 and 28. In order to eliminate the fluctuation in speed of the main-feeding drum 12, the feeding tension is controlled so that it cannot be varied. However, the use of an electric motor is not always necessary; that is, the control may be achieved by employing a powder brake.

The main-feeding drum 12 is driven by an electric motor 13. A tachometer generator 14 for detecting the speed of the drum 12 and a position detecting pulse generator 15 are coupled directly to the motor 13. The use of the tachometer generator 14 may be omitted if the output of the pulse generator 15 is subjected to frequency-to-voltage (F/V) conversion. In FIG. 1, reference numeral 16 designates the regulator of the motor 13. Reference numeral 23 is an electric motor for driving the sub-feeding drum 22; reference numeral 24, a tachometer generator; reference numeral 25, a pulse generator; and reference numeral 26, the regulator of the motor 23. Similarly, the use of the tachometer generator 24 may be omitted if the output of the pulse generator 25 is subjected to F/V conversion.

For example, a film may be fed as the main-web, out of the roll 10, while a liner sheet for the film may be fed as the sub-web out of the roll 20.

Figure 2:
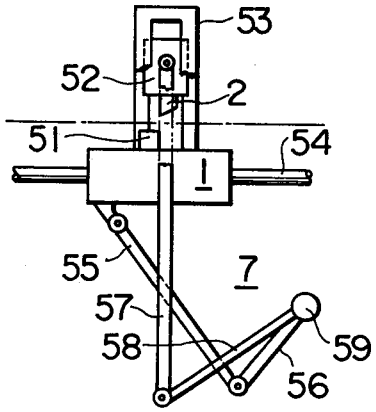
FIG. 2 is an explanatory diagram showing the construction of a cutter.

A cutter section is illustrated in more detail in FIG. 2. In this cutter section, a reciprocating stand 1 holds an upper cutting edge 2 and a lower cutting edge. The reciprocating stand 1 is arranged so that it is guided by a guide 54 to move in the direction of advancement of the web. An upper cutting edge fixing stand 52 is guided by an upper cutting edge vertical movement guide 53 so that the upper cutting edge 2 is moved perpendicularly to the lower cutting edge 51. The lower cutting edge 51 is fixedly secured to the swinging stand 1.

The reciprocating stand 1 is driven by crank mechanism 7 comprising a crank arm 56 and a connecting rod 55 which are coupled to a crank shaft 59. The upper cutting edge fixing stand 52 is driven by crank mechanism 7 comprising a crank arm 58 and a connecting rod 57 which are coupled to the crank shaft 59. While the reciprocating stand 1 is moved at the same speed as that of the web in the direction of advancement of the web, the upper cutting edge 2 is moved downward to engage with the lower cutting edge 51 to cut the web. In this connection, the respective lengths of the connecting rod 55 and the crank arm 56 are determined in accordance with the requirements of the cutting speed of the reciprocating stand 1 and the cutting speed variation thereof. The lengths of the connecting rod 57 and the crank arm 58 are determined in accordance with the requirements for the engagement depth of the upper and lower cutting edges and the sharing angle thereof, and the phase angle between the crank arms 56 and 58 is determined to obtain the optimum cutting.

Referring back to FIG. 1, reference numeral 3 designates an electric motor provided for the cutter; reference numeral 4, a speed detecting tachometer generator; reference numeral 5, a pulse generator, and reference numeral 6, a regulator provided for the motor 3. Similarly as in the case described above, the use of the tachometer generator 4 may be omitted if the output of the pulse generator 5 is subjected to F/V conversion. In FIG. 1, a cutter reference position detecting sensor 8, and a reduction gear 9 are shown driven by motor 3. The web cut off is conveyed by a catch conveyor 31 provided behind the cutter into a collecting device 30.

The cutting system further comprises: an electric motor 33 for driving the conveyor 31; a reduction gear 32; a tachometer generator 34 for detecting the speed of the motor 33; a web guide plate 37 and a control board 40 for determining a web length in cutting.

It has been determined by the invention that the cause of dull cutting and unsatisfactory cutting accuracy is the fluctuation in speed of the web. As a result, it has been concluded that the following conditions are essential for establishing the sufficient response of the cutter to the fluctuation in speed of the web. That is, in order to determine the cut length with high accuracy, it is necessary for the main-feeding motor 13 to run at a constant speed. Furthermore it is necessary to control the sub-feeding motor 23 and the cutter driving motor 3 to readily follow the movement of the main-web.

For this purpose, a value $\bar{J}$ is obtained from the following expression:

$$\bar{J}=J\ Wo/To$$

where J is the motor shaft conversion inertial moment including the load of each motor, Wo is the motor's rated speed, and To is the motor's rated torque.

If it is assumed that the values $\bar{J}$ of the main-feeding motor 13, the sub-feeding motor 23 and the cutter driving motor 3 are represented by $\bar{J}_F$, $\bar{J}_S$ and $\bar{J}_C$, respectively, then the inertial moments of the three motors are determined so that the values $\bar{J}$ satisfy the following expression:

$$\bar{J}_F>\bar{J}_S>\bar{J}_C$$

In addition, if necessary, a flywheel is provided.

If $\bar{J}_F$ is about two to ten times $\bar{J}_C$, and is about 1.5 to 3 times $\bar{J}_S$, and $\bar{J}_F > \bar{J}_S > \bar{J}_C$, then the optimum speed control and position control between the three values are established. As a result, the cut dimension can be maintained precisely. This is equivalent to the fact that the response of the cutter is increased to cancel the speed fluctuation which is caused during the main-feeding or the sub-feeding, to achieve the cutting without being affected by the speed fluctuation. Alternatively the response of the sub-feeding is increased to cancel the speed fluctuation which is caused during the main-feeding, to provide the follow-up which is not affected by the speed fluctuation.

The cutter 7 is driven by the crank mechanism 7 because the speed variation, in the direction of advancement of the web, of the cutter during the cutting operation is much less than that in the use of a rotary cutter.

In order to correctly cut the web (to prevent the web from being cut obliquely), the lateral movement speed of the cutter reciprocating stand 1 must be in coincidence with the speed of advancement of the web during the cutting operation. For this purpose, the cutter's reciprocating position is detected by the pulse generator 5 coupled directly to the cutter driving motor, while the web's movement speed is detected by the pulse generators 15 and 25 coupled directly to the web-feeding motors. In this case, a method is employed in which web movement pulses are thinned out for a period of time of from cutting start to cutting finish in accordance with conditions applied in association with the displacement of the cutter. The artificial information is issued as if the web's movement speed is apparently changed to control the cutter driving motor. The thinning-out circuit comprises a wire emory or a digital memory which, in this embodiment, is provided in the vicinity of the pulse input side of the regulator 6 of the motor 3.

Figure 4:
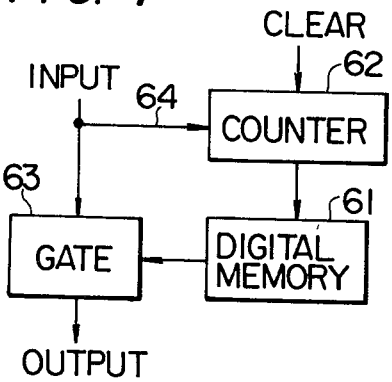
FIGS. 4 and 5 are a block diagram and waveform respectively illustrating the thinning circuit used in this invention.

One example of a thinning-out circuit employed in the present invention will now be briefly described with reference to FIGS. 4 and 5. FIG. 4 is a schematic block diagram in which a digital memory 61 receives counter 62 output and supplies one input to gate 63. The counter 62 is cleared by receiving a signal from cutter reference position detecting sensor 8. Once cleared, the counter begin counting pulses from pulse generator 15, transmitted on the line 64.

The signal at "INPUT" is from the pulse generator 15 coupled to the main motor 13. The counter 62 indicates addresses of the memory 61.

Within digital memory 61 the crank function is stored in the form of "high" and "low" pulses with respect to each of the addresses. The gate 63 is selectively opened or closed depending upon the output from the memory 61. The gate 63 is selectively opened to permit input pulses to pass as an output to control motor 3.

Figure 5:
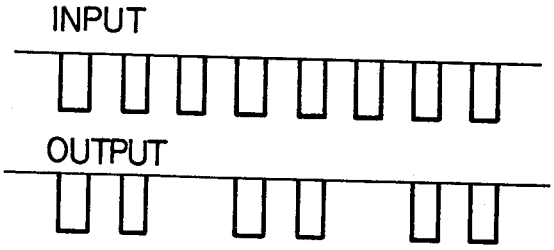

The waveform output is shown in FIG. 5. The input comprises pulses from pulse generator 15. The "thinned-out" output is shown in the lower line of FIG. 5. This output train of thinned pulses is used as a digital input to control motor 3. As described herein this thinning-out circuit is included as a part of the regulator 6.

In the case where the feed length of the sub-feeding drum 22 is shorter than that of the main-feeding drum 12 to cut the webs different in size, after the webs are cut once, the speed of the sub-feeding drum 22 is decreased until the next cutting operation to obtain the shorter length of the web. However, at the time instant of cutting the webs the speeds of the webs are equal to each other. Accordingly, while the speeds of the two webs being conveyed are different from each other before they are cut since the holding force of the catch conveyor 31 pulling the two webs are set to a small value (smaller than 1 Kg for instance), slip is caused between the webs to smoothly convey the latter.

Thus, the web is fed under the condition that the high frequency speed variation is reduced as much as possible by having $\bar{J}_F$ for main-feeding motor 13 at a high value. In this case, the tension is controlled with high accuracy so that the web feeding tension will not give torque disturbance to the main-feeding motor.

It is desirable that the web feeding length be determined by measuring the circumferential length with the pulses and the pulse generator 15 coupled through the motor 13 to the main-feeding drum 12. The coefficient for correction is unnecessary (0.01 mm per pulse for instance). However, in the case where the relationship between the pulse and the feeding length is unsatisfactory, a coefficient correcting device may be connected to the pulse generator 15. The signal of the pulse generator 15 is employed as a reference signal which drives the driving motor 23 of the sub-feeding drum 22, which is so designed as to have the value $\bar{J}_S$ smaller than the value $\bar{J}_F$.

After the speed of the sub-feeding drum is decreased to provide the shorter length of the web, the sub-feeding drum is digitally controlled so that the speed of the sub-feeding drum coincides with that of the main-feeding drum. Similarly as in the case of the main-feeding, it is desirable that the relationship between sub-feeding drum 22 and the pulse generator 25 be established so that no coefficient correction is required. However, if impossible, a coefficient correcting device may be connected to the pulse generator 25.

The output signal fo the main-feeding pulse generator is employed as a reference signal which drives the cutter driving motor 3 which is so designed as to have the value $\bar{J}_C$ much smaller than the value $\bar{J}_S$ of the sub-feeding motor 23. In the case where the coincidence in speed between the webs and the cutter is required, the cutter driving motor 3 is controlled by thinning out the above-described reference signals so that the lateral movement speed of the reciprocating stand 1 becomes equal to web speed during the cutting operation.

As is apparent from the above description, the cutting machine according to the invention, unlike the conventional one, does not use a measuring roller which is brought into contact with the web. If the measuring roller is used, the web is liable to be scratched or creased, or fluttering or noises are liable to be caused. In such a case if the web's speed variations can be measured with high accuracy, it is impossible to cancel the speed variations and the cutter cannot follow the speed variations. In the cutting machine according to the invention, control is effectuated by utilizing the pulse signals of the pulse generators coupled directly to the feeding motors which are designed to suppress the speed variations as much as possible. Hence, control is achieved with much higher accuracy.

In the catch conveyer 31, the contact pressure between the upper and lower belts is so adjusted to prevent the webs from being slackened but it does not give any torque disturbance over the allowance to the feeding drums. If the cut web enters the collecting section at too low a speed, it may be detained by friction. As a result, it is impossible to satisfactorily collect the cut webs therein. On the other hand, if the cut web is caused to enter the collecting section at too high speed, it may bounce back. Therefore, the speed of the catch conveyers 31 carrying the cut webs is set to allow the cut webs to be smoothly collected in the collecting section and generally to a value slightly higher than the web conveying speed (the speed of the conveyers being set to a constant value which is slightly higher than the speed of the webs in the case where the speed of the webs is slow). This control is achieved by providing a constant voltage adder in the circuit so that the speed of the catch conveyers is made higher than certain value of the web conveying speed, or by using a proportional control system so that the speed of the catch conveyers is gradually increased in response to the web speed.

Thus, as is apparent from the above description, the running web cutting machine for cutting the webs with high accuracy without using the measuring roller has been provided according to this invention.

While the invention has been described with reference to its preferred embodiment, it will be understood that the invention is not limited thereto or thereby.

With reference to the preferred embodiment, the case where two layers of material, that is the film and the paper are fed to the position of the cutter, and cut into a piece of film and a piece of paper which are different in length, has been described. However, it is apparent that the above-described requirements should be met even in the case of cutting a single layer of material. In this case, cutting can be achieved with high accuracy by connecting the pulse generator directly to the feeding motor, and by making the value $\bar{J}_F$ of the feeding motor higher than the value $J_C$ of the cutting motor.

In the case where a number of layers of materials are simultaneously cut to the same size, a number of feeding drums are driven through a reduction gear such as a worm reduction gear by a single feeding motor. In this case also, the above-described various relationships should be established. The feeding drums are not limited only to the suction drums. For example, a number of sheets can be fed by using a pair of nip rolls.

In the above-described embodiment, the two cut webs have different lengths from each other. In the case where the difference between the lengths of the two cut webs is constant or the lengths of the two cut webs should be equal to each other, if the difference between the diameters of the suction drums is made to be a predetermined value or the diameters of the suction drums are made to be equal to each other and a worm reduction gear is employed, then the suction drums can be driven by only one feeding motor.

In the above-described embodiment, the suction drums are disposed in parallel with the direction of advancement of the webs. However, they may be arranged vertically. Furthermore, in the above-described embodiment, the webs are merely cut off. However, in the case where slitting and cutting are carried out simultaneously as shown in FIG. 3, the relationships between the feeding drum and the cutter are similarly established as in the above-described embodiment.

Figure 3:
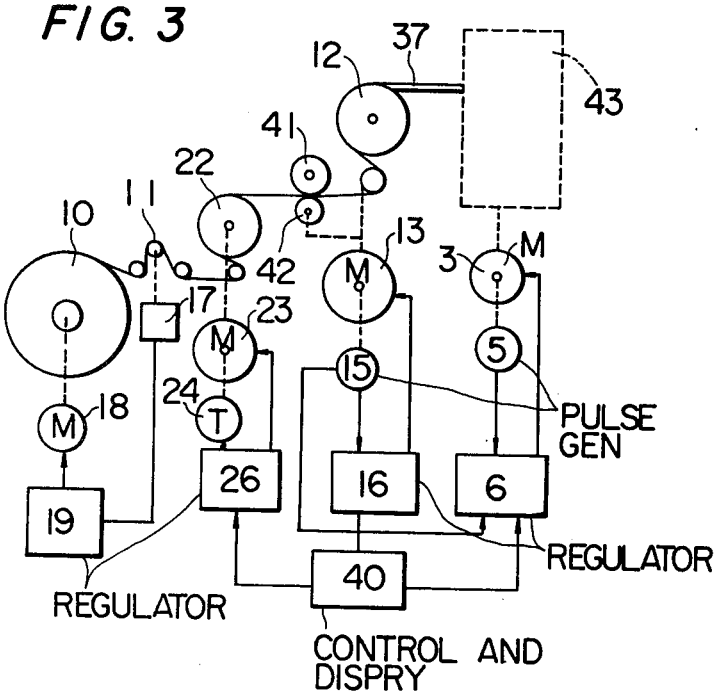
FIG. 3 is also an explanatory diagram illustrating a second embodiment of the invention.

In the embodiment of FIG. 3, as in the above-described embodiment, feeding a web is detected by a tension pick-up roll 11 and the web tension is detected by a tension pick-up 17. A feeding tension control motor 18 is coupled to a feeding roll 10 is controlled by a regulator 19. Also as in the above-described embodiment, a cutter is driven by means of a cutter driving motor 3 and a cutter position detecting pulse generator 5, the motor 3 being controlled by a regulator 6. In the embodiment shown in FIG. 3, no tachometer generator is employed, and instead the output of the pulse generator 5 which is subjected to F/V conversion by an F/V converter provided in the regulator.

A main-feeding drum 12, a feeding motor 13, a pulse generator 15 and a regulator 16 are similar to those in the above-described embodiment. The torque of the motor 13 is transmitted from its output shaft through a mechanical transmission mechanism to an upper cutting edge 41 and a lower cutting edge 42 of a slitter to drive these cutting edges.

With the sub-feeding drum 22 in this embodiment, current control is employed in order to keep the tension of the slit section. Accordingly, the main-feeding drum is not digitally coupled to the sub-feeding drum. However, it is necessary to select the values $\bar{J}$ of the motors to meet the expression $\bar{J}_F > \bar{J}_S > \bar{J}_C$.

While the invention has been explained herein with respect to the preferred embodiments as described, it is apparent that other modifications may be made without departing from the essential scope thereof.

We claim:

1. In a running web cutting machine in which a vertically movable cutter is driven by a crank mechanism the improvement comprising; a reciprocating stand holding an upper cutting edge and a lower cutting edge, said stand disposed for movement in the direction of advancement of a web along a guide, a cutter driver motor, said upper and lower cutting edges being driven by drive means coupled to a single crank shaft coupled to said cutter driving motor, wherein a value $\bar{J} = J\ Wo/To$, where J is the conversion inertial moment of a driving motor including a load, Wo is the rated speed thereof, and To is the rated torque thereof of said cutter driving motor is selected to be $\bar{J}_C$, and a value $\bar{J}$ of a web feeding motor driving a web feeding drum is represented by $\bar{J}_F$, then said cutter driving motor and said web feeding motor are so set that $\bar{J}_C$ is smaller than $\bar{J}_F$.

2. A machine as claimed in claim 1 further comprising a first pulse generator coupled to said web feeding motor, a second pulse generator coupled to said cutter driving motor, and a pulse thinning-out circuit for controlling a movement speed of said cutter in the direction of advancement of said web.

3. The machine as claimed in claim 2 wherein said thinning out circuit is disposed in a control circuit for said cutting driving motor.

4. A machine as claimed in claim 1 further including, a main-feeding drum and a sub-feeding drum provided so that two webs laid one on another can be cut simultaneously, and wherein a value $\bar{J}_f$ of a motor driving said main-feeding drum, a value $J_S$ of a motor driving said sub-feeding drum, and the value $J_C$ of said cutter driving motor are so set as that:

$$\bar{J}_F > \bar{J}_S > \bar{J}_C.$$

5. A machine as claimed in claim 4, further comprising digital control circuit means for controlling a feeding length of said sub-feeding drum to be shorter by a predetermined value than a feeding length of said main-feeding drum, and when said two webs are cut, the speeds of said two webs are equal to each other.

6. A machine as claimed in claim 1, further comprising catch conveyer means provided behind said cutter, said catch conveyer means for conveying pieces of cut webs, the speed of said catch conveyer means being set to a value higher than the speed of said web when the speed of said web is in a low speed range and to a value higher by a predetermined ratio than the speed of said web when the speed of said web has a predetermined value or higher.

7. A machine as claimed in claim 6 further comprising means to adjust the speed of said catch conveyer means.

8. The machine as claimed in claim 1 wherein said drive means comprises a first crank arm coupled to said crank shaft, a first connecting rod coupling said first crank arm to said reciprocating stand, a second crank arm coupled to said crank shaft and second connecting rod coupling said second crank arm to said upper cutting edge.

9. The machine as claimed in claim 1 wherein said lower cutting edge is fixed to said reciprocating stand.

10. The machine as claimed in claim 1 further comprising a cutter motor position detecting pulse generator and a regulator receiving the output of said pulse generator.

11. The machine as claimed in claim 10 further comprising a tachometer interposed between said cutter motor and said pulse generator.

* * * * *